United States Patent [19]

Kofahl

[11] 4,377,207

[45] Mar. 22, 1983

[54] TUBING ANCHOR

[76] Inventor: William M. Kofahl, Rte. 2, Box 297, Licking, Mo. 65542

[21] Appl. No.: 317,415

[22] Filed: Nov. 2, 1981

[51] Int. Cl.[3] ..... E21B 23/06

[52] U.S. Cl. ..... 166/212; 175/99; 188/67; 294/86.24

[58] Field of Search ..... 166/120, 206, 212, 216, 166/241; 175/98, 99; 285/140; 188/82.1, 82.3, 82.4, 67; 294/86.15, 86.24

[56] References Cited

U.S. PATENT DOCUMENTS

| | | | |
|---|---|---|---|
| 210,575 | 12/1878 | Stewart | 166/206 |
| 2,481,009 | 9/1949 | Gill | 175/99 |
| 3,851,707 | 12/1974 | Jett | 166/212 |

*Primary Examiner*—William F. Pate, III

*Assistant Examiner*—William P. Neuder

*Attorney, Agent, or Firm*—Jerry W. Mills

[57] ABSTRACT

A tubing string anchor (20) is provided for anchoring a tubing string (14) within a well bore (10). This prevents motion of the tubing string during a pumping operation. The anchor (20) includes a support (26) for mounting a number of roller assemblies (32–38). Each roller assembly includes a roller slip (40) for frictional engagement with the wall ( 28) of the well bore (10). Notches (52) on the roller slips may cooperate with pawl assemblies (68) to prevent the slips from rotating in at least one direction to anchor the tubing string within the well bore. The pawl assembly may be activated by the hydrostatic pressure within the internal passage (24) within the annular section (30) during the pumping action. This permits the tubing string to be positioned and removed from the well bore freely.

9 Claims, 2 Drawing Figures

TUBING ANCHOR

TECHNICAL FIELD

This invention relates to a device for fixing an object within surrounding structure, and in particular to fixing a down-hole tool within a well bore.

BACKGROUND ART

In recovering valuable materials, such as oil and water, from subsurface deposits, it is common to provide a tubing string down the well bore to act as a fluid conduit for bringing the material to the surface. In deposits where the reservoir pressure is insufficient, pumping action must be employed to recover the fluid. A pump may be positioned either at the surface or within the well bore to perform this function.

In operation, the tubing string has been found to work up and down on the up and down strokes of the pumping unit. This reduces the efficiency of recovery and may induce damage to the operating components. Therefore, a need has arisen for preventing the working of the tubing string during pumping.

DISCLOSURE OF THE INVENTION

In accordance with the present invention, a tubing string anchor is provided for use in a well bore having walls. The anchor is used for anchoring a tubing string with a passage therethrough within the well bore. The anchor includes an annular section having an internal passage forming a portion of the tubing string passage. At least one roller slip is rotatably mounted on the annular section for rolling frictional engagement with the walls of the bore hole. The roller slip has a plurality of notches formed on the outer surface thereof. At least one pawl is mounted on the anchor section. The pawl is engagable with selected ones of the plurality of notches to resist rotational motion of the roller slip in at least one direction to anchor the tubing string in the well bore. Structure is provided for engaging the pawl with the selected ones of the plurality of notches.

In accordance with another aspect of the present invention the engaging structure causes the pawl to engage selected ones of the plurality of notches continuously. This permits the tubing string to be moved in only one direction within the well bore.

In accordance with yet another aspect of the present invention, an aperture is formed within the annular section which opens into the passage and extends adjacent the roller slip. The engaging structure includes a shaft secured to the pawl for slidable sealed contact with the walls of the aperture. The presence of fluid within the passage of the annular section at a pressure exceeding the pressure in the well bore adjacent the roller slip acts on the shaft to slide the shaft through the aperture and engage the pawl to selected ones of the plurality of notches in the roller slip.

In accordance with still another aspect of the present invention, a roller block is supported on the annular section in slidable sealed contact with the aperture. The roller slip and pawl are supported in the roller block. The roller block slides with the fluid pressure in the internal passage to urge the roller slip against the wall of the well bore.

BRIEF DESCRIPTION OF THE DRAWINGS

A more complete understanding of the invention may be had by reference to the following detailed description when taken in conjunction with the accompanying drawings, wherein.

DETAILED DESCRIPTION

Figure 1:
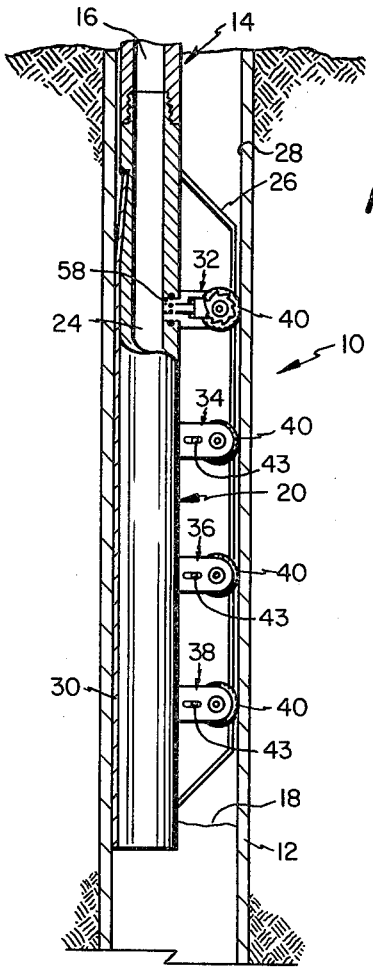
FIG. 1 is a partial cross section of a well bore with a tubing string anchor forming one embodiment of the invention positioned therein.

Referring now to the drawings, wherein like reference characters designate like or corresponding parts throughout the several views, FIG. 1 illustrates a portion of a well bore 10 for recovery of fluids, such as oil and water, from subsurface reservoirs. The well bore may be lined with a cylindrical casing 12 along substantially its entire length.

A tubing string 14 having a continuous internal passage way 16 therethrough is run down the well bore to beneath the fluid level 18 of the fluid therein. A pump may be positioned on the surface above the well bore to pump the fluid through the passageway 16 to the surface for storage.

To prevent movement of the tubing string 14 during pumping, a tubing string anchor 20 is provided. The tubing string anchor includes annular section 22 which forms part of the tubing string 14. The annular section has a passageway 24 formed therethrough of substantially equal diameter to the passageway 16.

The annular section 22 includes a support structure 26 extending toward the inner wall 28 of the casing 12. On the side opposite the structure 26 is positioned a wear plate 30. The wear plate 30 is designed to frictionally engage the wall 28 when the tubing string is anchored in the well bores as will be described hereinafter.

The support structure 26 mounts roller assemblies 32, 34, 36 and 38 in vertical alignment. The roller slip 40 of each assembly can be urged into frictional engagement with the wall 28 opposite the wear plate. When the roller slips 40 are free to rotate, the tubing string may be readily raised or lowered within the well bore. During this motion the wear plate 30 slides along the inner wall 28 and the roller slips 40 rotate if they are in contact with the wall 28. By providing resistance to the rotation of the roller slips 40 when the slips are urged against the wall, the tubing string 14 may be anchored within the well bore.

Figure 2:
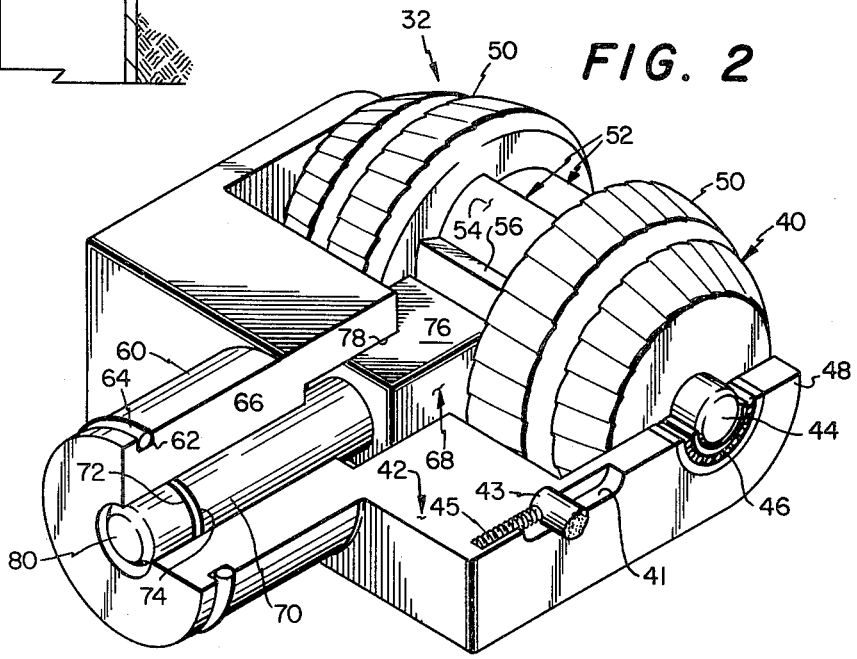
FIG. 2 is a perspective view of a roller slip and pawl assembly for use in the tubing string anchor.

Roller assembly 32 is illustrated in greater detail in FIG. 2. The roller assemblies are substantially identical so that description of assembly 32 will be sufficient to describe all assemblies.

The roller slip 40 is rotatably mounted to a roller block 42. The roller block 42 is slidably mounted in the structure 26 to move the roller slip 40 into and out of frictional engagement with the wall 28. The block includes grooves 41 formed on opposed faces thereof to receive bolts 43 secured to structure 26. The bolts confine the roller block within structure 26, permitting the block to move only in the radial direction from the center line of the well bore 10 outward to the wall 28. Near the outermost radial limit of travel of block 42, its associated roller slip will be in frictional engagement with wall 28. When block 42 is positioned toward the innermost radial position of its travel, the associated roller slip is out of frictional engagement with wall 28. Springs 45 between each of the bolts 43 and roller block 42 urge the block to its innermost radial position.

The slip 40 includes pins 44 extending from either end for mounting within roller bearing 46. The roller bearings 46, in turn, are mounted within parallel extending arms 48 of block 42.

The roller slip 40 includes multiple curved friction surfaces 50 formed on its outer surface for frictional engagement with the wall 28. The friction surfaces are shaped with upwardly facing teeth or wickets to dig into wall 28 to form a tight grip. The friction surfaces are curved in a plane perpendicular to the axis of rotation to facilitate the rotation. The surfaces are also curved in a plane parallel to the rotational axis with a curvature corresponding to the curvature of the inner wall 28 to insure adequate contact between the surfaces and the wall.

A plurality of notches 52 are formed in the roller slip between the friction surfaces. Each of the notches includes a smoothly curved outwardly extending ramp surface 54 and a planer face surface 56. The notches lie radially within the friction surfaces so that no portion of the notches contact the wall 28.

The annular section 22 has ports 58 formed therethrough to permit communication between the passageway 24 to the casing exterior of the tubing string. Each roller block 42 includes an extension 60 designed to be received within a port. The extension may have a seal groove 62 formed in the outer periphery thereof for receiving an O-ring seal 64. The O-ring seal prevents fluid motion in the annular space between the port and extension when the block slides between its limits of motion determined by bolts 43 and grooves 41.

An aperture 66 is formed within the extension which opens into the passageway 24. A rachet assembly 68 is provided which includes a pin 70 adapted for sliding motion within the aperture 66. The pin may have a seal groove 72 in its outer circumference for receiving an O-ring seal 74 to prevent passage of fluid through the annular space between the aperture and pin.

The rachet assembly further includes a pawl 76. The pawl has a front face for engagement with the notches 52 on the roller slip to prevent rotation of the slip in at least one direction.

The pawl may have a non-circular cross section and is adapted to slide within an opening 78 in the roller block having a similar cross section. This prevents the rachet from moving in any direction other than into and out of engagment with the notches 52.

When the passageways 16 and 24 are empty of fluid, the tubing string with tubing anchor 20 may be freely moved up and down with casing 12. The movement of the roller slips will urge the roller blocks 42 radially inward to move the roller slips out of engagement with wall 28 and urge the rachet assemblies 68 out of engagement with the roller slips. A spring may also be provided to bias the rachet assemblies out of engagement. When the tubing string 14 is properly positioned within the well bore, the pumping action will be initiated. This will cause the fluid within the well bore to travel through the passageways 16 and 24. The hydrostatic pressure in the passageways increases as the pumping continues. The pressure acts on the exposed end 79 of extension 60 to move the roller blocks 42 radially outward so that the roller slips frictionally engage the wall 28. This pressure further acts on the exposed end 80 of the pawl assembly 68 to urge the pawl 76 into engagement with the notches 52 to resist rotational motion of the roller slips in at least one direction. The pawls and notches may be designed so that rotational motion in either direction is resisted. The pawl assemblies and roller slips thereby cooperate to anchor the tubing string 14 within the well bore 10 to permit efficient pumping operations.

In one modification of the tubing string anchor 20, the pawls 76 may be continuously urged into engagement with the notches 52 as by a biasing spring. The roller slips will be permitted to freely rotate in only one direction. This direction would be designated to permit the tubing string 14 to be moved downwardly within the well bore to the desired position for pumping.

In a second modification, the grooves 41 could be designed to maintain the roller blocks 40 so that the roller slips are in continuous frictional engagement with wall 28.

Although a single embodiment of the invention has been illustrated in the accompanying drawings and described in the foregoing detailed description, it will be understood that the invention is not limited to the embodiments disclosed, but is capable of numerous rearrangements, modifications, and substitutions of parts and elements without departing from the spirit of the invention.

I claim:

1. A tubing string anchor for anchoring a tubing string having a passage therethrough in a well bore having walls, comprising:

an annular section forming a portion of the tubing string and having an internal passage aligned with the passage in the tubing string;

at least one roller slip rotatably mounted on said annular section for rolling frictional engagement with the walls of the well bore, said roller slip having a plurality of notches formed on the outer surface thereof;

at least one pawl mounted to said annular section for engagement with selected ones of said plurality of notches to resist rotational motion of said roller slip in at least one direction to anchor the tubing string within the well bore; and engaging means for engaging said pawl with said selected ones of said plurality of notches.

2. The tubing string anchor of claim 1 wherein said engaging means continuously urges said pawl into engagement with said selected ones of said plurality of notches.

3. The tubing string anchor of claim 1 wherein said engaging means includes means for permitting fluid communication between the passage in said annular section and said pawl, the presence of pressurized fluid in the passageway in said annular section urging said pawl into engagement with said selected ones of said plurality of notches.

4. The tubing string anchor of claim 1 further comprising at least one roller block means slidably supported on said annular structure, said roller block means mounting one of said roller slips and a pawl, said roller block means being slidable between retracted and extended positions, said roller slip being in frictional engagement with the walls of the well bore when said roller block means is in the extended position, said tubing string anchor further comprising means for permitting fluid communication between the passage in said annular section and said roller block means, the presence of pressurized fluid in the passageway in said annular section urging said roller block means to the extended position.

5. A tubing string anchor for anchoring a tubing string having a passage therein in a well bore having a wall, comprising:

an annular section forming a portion of the tubing string and having an internal passage aligned with the passage in the tubing string;

at least one roller slip rotatably mounted on said annular section for rolling frictional engagement with the walls of the well bore, a portion of said annular section opposite said roller slip being in sliding engagement with the wall of the well bore, the wall contacting portions of said roller slip being contoured to the wall of the well bore, said roller slip further having a plurality of notches formed on a portion of the outer surface thereof;

at least one pawl assembly slidably mounted in said annular section, said pawl assembly including a pawl for engagement with selected ones of said plurality of notches to resist rotational motion of said roller slip in at least one direction to anchor the tubing string in the well bore, a portion of said pawl assembly having a non-circular cross section received within a portion of said annular section having a non-circular cross section to limit motion of said pawl into and out of engagement with said selected ones of said plurality of notches; and engaging means for moving said pawl into engagement with said selected ones of said plurality of notches to anchor the tubing string.

6. The tubing string anchor of claim 5 wherein said engaging means continuously urges said pawl into engagement with said selected ones of said plurality of notches to resist motion of the tubing string in one direction within the well bore.

7. The tubing string anchor of claim 5 wherein said pawl assembly further includes a pin and said engaging means includes a port in fluid communication with the internal passage of said annular section, said pin being positioned within said port for slidable sealed motion, fluid pressure in the internal passage of said annular section acting against the exposed end of said pin to urge said pawl into engagement with said selected ones of said plurality of notches.

8. The tubing string anchor of claim 5 further comprising at least one roller block slidably supported on said annular section, said roller block rotatably mounting at least one of said roller slips and slidably mounting at least one of said pawl assemblies, said roller block being slidable between extended and retracted positions, said at least one of said roller slips being in frictional engagement with the wall of the well bore in the extended position, the tubing string anchor further comprising port means in fluid communication with the internal passage of said annular section, said roller block being positioned within said port means for slidable sealed motion, fluid pressure in the internal passage of said annular section acting against the exposed end of said roller block to urge said roller block to the extended position.

9. A tubing string anchor for anchoring a tubing string having a passage therein in a well bore having a wall, comprising:

an annular section forming a portion of the tubing string and having an internal passage aligned with the passage in the tubing string;

at least one roller assembly slidably secured to said annular section, said roller assembly including:

a roller block having opposed elongate slots formed therein for receiving bolt means secured to said annular section for permitting the roller block to slide between retracted and extended positions, said roller block further having an extension for slidable sealing engagement within a port formed in said annular section, said extension having an aperture formed therein in fluid communication with the internal passage of said annular section;

at least one roller slip rotatably mounted on said roller block between extending arms thereof for rolling frictional engagement with the walls of the well bore when the roller block is in the extended position, said roller slip including a multiply curved friction surface for rolling and contoured to conform to the wall of the well bore, said roller slip further having a plurality of notches defined on its external surface;

a pawl assembly slidably received in said roller block, said pawl assembly having a pawl for engagement with selected ones of said plurality of notches to resist rotational motion of said roller slip in at least one direction to anchor the tubing string in the well bore, said pawl assembly further having a pin for sliding sealed contact with said aperture with one end thereof exposed to fluid in said internal passage;

a wear plate secured on said annular section for slidable contact with the wall opposite the roller slip contacted surface of the wall; and fluid pressure in the internal passage of said annular section acting against the exposed end of the extension of the roller block to urge the roller block to the extended position and acting against the exposed end of said pin to urge said pawl into engagement with said selected ones of said plurality of notches.

* * * * *